United States Patent [19]

Mishina et al.

[11] 4,363,851

[45] Dec. 14, 1982

[54] METAL-DEPOSITED PAPER AND METHOD FOR PRODUCTION THEREOF

[75] Inventors: Noritoshi Mishina, Sowa; Yutaka Hirota, Mitaka; Satoshi Nakamura, Ohmiya, all of Japan

[73] Assignee: Mitsui Petrochemical Industries, Ltd., Tokyo, Japan

[21] Appl. No.: 217,583

[22] Filed: Dec. 18, 1980

[30] Foreign Application Priority Data

Mar. 31, 1980 [JP] Japan ..... 55-42526

[51] Int. Cl.[3] ..... B05D 1/36; B05D 7/24; B32B 15/08; B32B 27/10

[52] U.S. Cl. ..... 428/333; 229/3.5 MF; 426/126; 427/209; 427/250; 427/296; 427/404; 427/411; 427/419.1; 428/335; 428/336; 428/339; 428/511; 428/514; 428/522; 428/537

[58] Field of Search ..... 428/209, 211, 461–464, 428/511, 512, 333, 335, 336, 339, 514, 522, 537; 156/327, 332–334; 206/524.1, 524.2, 524.3; 229/3.5 MF; 426/126; 427/209, 250, 294, 296, 297, 404, 411, 419.1

[56] References Cited

U.S. PATENT DOCUMENTS

| | | | |
|---|---|---|---|
| 2,838,437 | 6/1958 | Busse et al. | 156/334 |
| 2,970,129 | 1/1961 | Rugg et al. | 260/29.6 H |
| 3,048,511 | 8/1962 | Strawinski | 428/511 |
| 3,250,638 | 5/1966 | Lassitor | 428/461 |
| 3,264,272 | 8/1966 | Rees | 156/332 |
| 3,365,409 | 1/1968 | Lanthier | 156/327 |
| 3,484,338 | 12/1969 | Britton et al. | 260/29.6 R |
| 3,730,752 | 5/1973 | Garza et al. | 428/457 |
| 3,764,458 | 10/1973 | Ziegel | 156/334 |
| 4,254,173 | 3/1981 | Peer | 428/512 |

FOREIGN PATENT DOCUMENTS

| | | | |
|---|---|---|---|
| 2129358 | 12/1971 | Fed. Rep. of Germany | 428/461 |
| 1367662 | 9/1974 | United Kingdom | 428/461 |

*Primary Examiner*—Bruce H. Hess
*Attorney, Agent, or Firm*—Sherman & Shalloway

[57] ABSTRACT

A metal-deposited paper comprises a paper substrate; a thin continuous coating (a), formed on one surface of the paper substrate, of a film-forming resin having good adhesion to metal, resin coating (a) having a metal film deposited thereon; and a thin continuous coating (b) of polyvinyl alcohol formed on the other surface of the paper substrate; and a process for producing a metal-deposited paper, comprises the following steps; (i) a step of applying a thin continuous coating (a) of a film-forming resin having good adhesion to metal to one surface of a paper substrate; (ii) a step of applying a thin continuous coating (b) of polyvinyl alcohol on the other surface of the paper substrate; and (iii) a step of vacuum-depositing a metal on the surface of the resin coating (a).

29 Claims, No Drawings

METAL-DEPOSITED PAPER AND METHOD FOR PRODUCTION THEREOF

This invention relates to a metal-deposited paper and to a method for production thereof. More specifically, this invention relates to a metal-deposited paper, especially an aluminum-deposited paper, which substantially retains the inherent properties of paper and has low air- and moisture-permeability and improved stacking characteristics and in which a smooth metal-deposited layer having a superior metallic luster is firmly bonded to the substrate paper, and to a method for production thereof.

Metal-incorporated paper obtained by bonding an aluminum foil to paper, because of its decorative appearance and low air- and moisture-permeability, is widely used in articles desired to be protected from moisture absorption or dissipation of volatile components, for example as packaging material for confectionery, tobaccos, medicines, etc. or as labels. A composite obtained by bonding a zinc foil to paper is used as a paper condenser.

Such a metal-incorporated paper, however, has the defect that since the metal foil can be reduced in thickness only to a limited extent and is liable to have pinholes, the cost of production rises, and the properties of the metal foil appear predominantly to cause a loss of the characteristics of paper.

As one means of avoiding such a defect, it may be possible to vacuum-deposit aluminum or zinc on one or both surfaces of paper. A product obtained by vacuum-depositing such a metal on untreated paper still predominantly has the properties of paper itself and exhibits high air-permeability and no moisture proofness, and moreover, the uneven surface of the paper is reproduced as such on the metal-deposited layer which is extremely thin. Accordingly, the product has no luster and there is no significance in coating paper with metal. The paper condenser mentioned above is required to have a smooth surface of uniform thickness and be free from pinholes, but the aforesaid zinc depositing method cannot meet this requirement.

It may also be possible, as in a conventional practice, to vacuum-deposit a metal such as aluminum or zinc on a plastic film, and bond the metal-deposited plastic film to paper. For this purpose, the plastic film should have self-supporting property and be considerably thick. A sheet obtained by bonding such a plastic film to paper scarcely retains the inherent properties of paper, such as bursting property and bendability, and strongly shows the properties of the plastic film. Hence, there is no significance in bonding paper to the metal-deposited plastic film.

Likewise, it may also be possible to laminate a plastic film to paper, and deposit a metal on the surface of the plastic film in this laminate. In this structure, the thickness of the plastic film can be reduced to a greater extent than in the case of using the self-supporting plastic film. However, the thickness of the plastic film is still fairly large, and the inherent properties of paper tend to be lost. Furthermore, such a method would be uneconomical since a laminated paper roll of a large diameter must be placed into a batchwise-operated vacuum deposition device.

Depending upon end uses, it is usual that the aluminum layer of an aluminum-deposited paper or an aluminum laminate paper is processed by, for example, printing, coating of a resin, or bonding of a plastic film. Accordingly, the aluminum surface should have surface characteristics suitable for such processing, e.g. printability or bonding characteristics.

Intrinsically, the aluminum surface is chemically active, and has a high wetting tension and good adhesion to inks or adhesives. In most cases, the aluminum-deposited or aluminum-laminated papers are stored or used in the rolled or stacked state. In such cases, the aluminum surface makes direct contact with the paper substrate surface of the aluminum-deposited or aluminum-laminated paper, and the good surface characteristics of the aluminum may be impaired.

The present inventors made various investigations about the cause of this phenomenon, and discovered the following fact. Each of the various substrates shown in Table 1 below is overlaid on the aluminum surface of an aluminum-deposited paper immediately after vacuum deposition and allowed to stand. When the substrate is paper, the wetting tension of the aluminum surface is drastically reduced and its adhesion to inks becomes poor. But when the substrate is a polyester film for metal deposition, no such phenomenon is noted. This has led to the discovery that a substance which contaminates aluminum is present in the substrate paper (natural pulp paper) to be in contact with the aluminum surface, and on contact, this substance moves to the surface of the aluminum layer, thereby reducing the wetting tension and ink receptivity of the aluminum surface.

TABLE 1

| Substrate contacted | Wetting tension (dynes/cm) | Ink adhesion |
|---|---|---|
| Clay coated paper | 33 | 1 |
| Wood-free paper | 34 | 1 |
| Simili | 33 | 1 |
| Polyester film | >56 | 5 |

Note 1:
The substrate is overlaid on the aluminum surface of the aluminum-deposited paper immediately after vacuum deposition, and the assembly is aged for 3 days in an oven at 40° C. under a load of 5 g/cm$^2$ and used as a measuring sample.
Note 2:
The wetting tension is measured in accordance with ASTM D2578.
Note 3:
A commercially available white printing ink GNCST, (a product of Toyo Ink Mfg., Co., Ltd.) is coated on the aluminum surface, and dried at room temperature. An adhesive cellophane tape is applied to the sample and peeled at an angle of 180°. The ink-adhering area after the peel test is evaluated on the following scale.

| Ink adhesion | Ink-adhering area (%) |
|---|---|
| 5 | 100 |
| 4 | less than 100 and at least 90 |
| 3 | less than 90 and at least 75 |
| 2 | less than 75 and at least 50 |
| 1 | less than 50 |

The present inventors have extensively worked to remove the cause of degradation of the surface characteristics of the aluminum-deposited layer in contact with paper, and consequently found that it is effective to provide a barrier layer for preventing migration of the contaminating substance in the paper substrate to the paper substrate surface opposite to the aluminum-deposited layer. Polyvinyl alcohol has been found to be especially effective as such a barrier-forming resin in contrast to vinylidene chloride-type latexes or acrylic emulsions which produce only a slight effect. It has been found that polyvinyl alcohol gives a sufficient effect even when used in a very small amount.

It is an object of this invention therefore to provide a metal-deposited paper which substantially retains the inherent properties of paper, such as bursting property, bendability (flexibility), strength, elongation and hardness, and in which a smooth metal-deposited layer having a superior metallic luster is firmly bonded to the paper substrate.

Another object of this invention is to provide a metal-deposited paper which substantially retains the inherent properties of paper and has low air- and moisture-permeability and in which a smooth metal-deposited layer having a superior metallic luster is firmly bonded to the paper substrate.

Still another object of this invention is to provide such a metal-deposited paper in which the properties of the deposited metal surface are not impaired even when the paper is in the stacked state.

A further object of this invention is to provide a method for producing such a metal-deposited paper.

Other objects and advantages of this invention will become apparent from the following detailed description.

According to this invention, there is provided a metal-deposited paper comprising a paper substrate; a thin continuous coating (a), formed on one surface of the paper substrate of a film-forming resin having good adhesion to metal, resin coating (a) having a metal film deposited thereon; and a thin continuous coating (b) of polyvinyl alcohol formed on the other surface of the paper substrate.

A first characteristic feature of the metal-deposited paper provided by the present invention is that a continuous coating (a) of a film-forming resin having good adhesion to metal is provided on one surface of the paper substrate as an interlayer for levelling the surface of the paper substrate and strengthening adhesion between the paper substrate and the metal-deposited layer, in such a thickness as to cause no substantial loss of the inherent properties of paper.

The "film-forming resin having good adhesion to metal", used in this invention, may include thermoplastic resins having no polar group such as styrene/butadiene copolymer and polybutadiene. But synthetic thermoplastic resins having at least one polar group such as a carboxyl group, a carboxylate group (i.e., carboxyl in the form of a salt or ester), a halogen atom, an acyloxy group or a nitrile group, particularly those containing a carboxyl group or a carboxylate salt group, have better adhesion to metal, and are therefore preferred.

Specific examples of such a polar group-containing resin are given below.

(1) Carboxy-Modified Olefinic Resins

Resins in this group include copolymers of olefins and $\alpha,\beta$-ethylenically unsaturated carboxylic acids or the derivatives thereof, and grafted copolymers resulting from grafting of $\alpha,\beta$-ethylenically unsaturated carboxylic acids or the derivatives thereof to olefinic polymers.

The olefins are, for example, those having 2 to 12 carbon atoms, such as ethylene, propylene, butene-1, 4-methyl-1-pentene and hexene-1. Examples of the olefinic polymers are polyethylene, polypropylene, polybutene-1, poly-4-methyl-1-pentene, ethylene/propylene copolymer, ethylene/butene-1 copolymer, ethylene/4-methyl-1-pentene copolymer, ethylene/hexene-1 copolymer, propylene/butene-1 copolymer, and 4-methyl-1-pentene/decene-1 copolymer.

Examples of the $\alpha,\beta$-ethylenically unsaturated carboxylic acids to be copolymerized or graft-copolymerized with these olefins or olefinic polymers include $\alpha,\beta$-ethylenically unsaturated monocarboxylic acids having 3 to 10 carbon atoms such as acrylic acid, methacrylic acid, crotonic acid, isocrotonic acid and 1-undecylenic acid, and $\alpha,\beta$-ethylenically unsaturated dicarboxylic acids having 4 to 20 carbon atoms such as maleic acid, itaconic acid, citraconic acid and 5-norbornene-2,3-dicarboxylic acid. Examples of the derivatives of these unsaturated carboxylic acids are derivatives of carboxylic acids convertible to carboxylic acids by reaction with water, such as acid anhydrides, esters, acid amides and acid imides. These $\alpha,\beta$-ethylenically unsaturated carboxylic acids or their derivatives can be copolymerized in an amount of generally about 5 to about 45% by weight, preferably about 10 to about 20% by weight, in the copolymer or graft copolymer.

If desired, the copolymer or graft copolymer obtained by using the derivatives of the carboxylic acids can be converted to those containing carboxyl groups by hydrolysis. At least some of the free carboxyl groups in the carboxyl-containing copolymer or graft-copolymer may be in the form of salts such as alkali metal salts or alkaline earth metal salts (e.g., potassium, sodium, calcium or zinc salts) or may be ionically crosslinked by these metals.

Typical examples of these carboxy-modified olefinic resins are ethylene/acrylic acid copolymer, ethylene/methyl acrylate/acrylic acid copolymer, ethylene/methacrylic acid copolymer, ethylene/methyl methacrylate/methacrylic acid copolymer, acrylic acid-grafted polyethylene, maleic anhydride-grafted polyethylene, and maleic anhydride-grafted polypropylene.

Of these, ionomer resins and $\alpha,\beta$-ethylenically unsaturated carboxylic acid-grafted polyolefins having an acid value of about 30 to about 150, preferably about 50 to about 130, are especially suitable. A typical ionomer resin is a $Na+$ or $K+$ ionically crosslinked product of ethylene/methacrylic acid copolymer having a methacrylic acid unit content of about 5 to 45% by weight, preferably about 10 to about 20% by weight. If the methacrylic acid unit content exceeds 45% by weight, a coated film prepared from the resin has poor water resistance and heat resistance. If it is less than 5% by weight, the self dispersibility of the resin becomes poor. About 30 to 80% of the methacrylic acid units present are neutralized with $Na+$ or $K+$. This ionomer resin has self-dispersibility as described hereinbelow, and gives an aqueous dispersion having a small particle size and good storage stability.

(2) Halogen-Containing Vinyl Resins

Resins in this group include vinyl chloride resins such as polyvinyl chloride, and ethylene/vinyl chloride copolymer, vinylidene chloride resins such as polyvinylidene chloride, vinylidene chloride/butadiene/methyl acrylate copolymer and vinylidene chloride/acrylic acid copolymer, and chlorinated polyolefins such as chlorinated polyethylene and chlorinated polypropylene. These resins can be used either singly or in combination with each other. The vinylidene chloride resins are preferred.

(3) Vinyl Acetate Resins

Resins of this group include polyvinyl acetate, vinyl acetate/ethylene copolymer, vinyl acetate/acrylate ester copolymers, vinyl acetate/dibutyl maleate copolymer, and partially saponified products thereof.

(4) Acrylic Resins

These resins include homopolymers or copolymers of acrylic monomers such as acrylic acid, methacrylic acid, or $C_1$–$C_8$ alkyl esters of acrylic or methacrylic acid such as methyl acrylate, methyl methacrylate, ethyl acrylate, butyl acrylate, octyl acrylate and isobutyl methacrylate, and copolymers of a major proportion of these acrylic monomers with a minor proportion of other comonomers such as styrene, acrylonitrile, vinyl chloride, vinylidene chloride and ethylene. Some examples of copolymers of acrylic monomer and other comonomers are styrene/butyl acrylate/butyl methacrylate copolymer, styrene/methyl methacrylate/butyl methacrylate copolymer and styrene/methyl methacrylate copolymer.

(5) Other Polar Group-Containing Resins

Acrylonitrile-butadiene copolymer

The above-exemplified polar group-containing resins can be used either singly or in combination with each other. Of the above resins, the carboxy-modified olefinic resins are most suitable.

The polar group-containing resins may be used as a mixture with compatible resins having no polar group. For example, the carboxy-modified olefinic resins may be mixed with vinyl acetate resins such as ethylene/vinyl acetate copolymer, its saponification product, or olefinic resins such as polyethylene, polypropylene, poly-1-butene, poly-4-methyl-1-pentene, ethylene/propylene copolymer, ethylene/1-butene copolymer, ethylene/butadiene copolymer, ethylene/propylene/butadiene terpolymer, ethylene/propylene/dicyclopentadiene terpolymer, ethylene/propylene/ethylidenenorbornene terpolymer, propylene/1-butene copolymer, propylene/butadiene copolymer, and mixtures of these polymers. When the polar group-containing resin is used in admixture with a resin containing no polar group, such as the aforesaid olefinic resins, the proportion of the polar group-free resin should be limited to the one which does not markedly reduce the adhesion of the resin mixture to metal. Although the mixing proportion is not critical, it is generally desirable that the polar group-free resin be used in an amount of up to 50% by weight, preferably up to 40% by weight, based on the total weight of these two resins.

From the viewpoint of the ease of forming a continuous coating, the aforesaid resin for formation of the interlayer should desirably have a melt index measured by ASTM D1238-57T of at least about 0.1 g/10 min., preferably at least about 0.5 g/10 min.

So long as the film-forming resin can level the uneven surface of the paper substrate and form a continuous coating thereon, it should be applied in as thin a layer as possible so that the inherent properties of the paper substrate, such as bursting property, bendability (flexibility), strength, elongation and hardness, can be substantially retained. The thickness of the continuous layer of the resin differs depending upon the type of the film-forming resin used. Generally, the suitable thickness of the resin coating on the paper substrate is about 1 to about 30 microns, preferably about 2 to about 20 microns.

Accordingly, the film-forming resin may be applied to the paper substrate by any known method which can give a very thin continuous coating. For example, depending upon the type of the resin used, melt-coating or solution coating is possible. With the melt coating method, it is difficult to form a thin smooth continuous coating. With the solution coating method, the resin may be absorbed by the paper and therefore the inherent properties of the paper tend to change. It has been found in accordance with this invention that a very thin continuous coating of the resin can be formed very easily by coating an aqueous dispersion of the film-forming resin on the paper substrate, and therefore, this method is most convenient in this invention.

The aqueous dispersion of the film-forming resin can be prepared in a manner known per se. For example, it may be prepared by forming an aqueous dispersion of the film-forming resin by emulsion polymerization or suspension polymerization; or by re-dispersing a film-forming resin, prepared separately, in an aqueous medium. The concentration of the resin in the aqueous dispersion is not critical, and can be varied according to the type of the resin used, etc. To provide a suitable viscosity for coating, the solid concentration of the aqueous dispersion is advantageously about 10 to about 60% by weight, preferably about 20 to about 50% by weight, based on the weight of the aqueous dispersion. Desirably, the resin dispersed in the aqueous dispersion is in the form of particles having the finest possible particle diameter. From the standpoint of the viscosity of the aqueous dispersion, the smoothness of the resulting coating, etc., it is desirable that the particles of the resin should have an average particle diameter of about 0.005 to about 20 microns, preferably about 0.01 to about 15 microns.

If emulsifiers, surface-active agents and other additives used in performing emulsion polymerization or suspension polymerization to prepare such an aqueous dispersion are volatile, they may evaporate when a paper substrate coated with the aqueous dispersion is placed under vacuum for vacuum deposition. As a result, it is difficult to produce a high vacuum or a long period of time is required for producing a high vacuum. Accordingly, when such additives are used, their amounts should be reduced as much as possible, for example, to not more than about 5% by weight based on the weight of the film forming resin in an aqueous dispersion. Or it is recommended to use high-molecular-weight emulsifiers or surface-active agents having low volatility.

In this regard, the carboxy-modified olefinic resin, particularly the ionomer resin and $\alpha,\beta$-ethylenically unsaturated carboxylic acid-grafted polyolefin, is an especially preferred resin for use in this invention because it is self-dispersible, can be re-dispersed in fine particles in an aqueous medium, and has excellent adhesion to metals.

The ionomer resin used in this invention is a thermoplastic resin obtained by copolymerizing the olefin and the $\alpha,\beta$-ethylenically unsaturated carboxylic acid, and neutralizing some or all of carboxyl groups in the resulting carboxyl-containing polyolefin with a metal such as sodium, potassium, magnesium or zinc to ionize them. This resin has the property of easily self-dispersing in water, without the use of a surface-active agent, to give an aqueous dispersion. The aqueous dispersion of the ionomer resin is used alone or as a mixed aqueous dispersion with a polyolefinic resin inherently having no self-dispersibility prepared by simply mixing it uniformly with a compatible resin having or not having a polar group, such as an ethylene/vinyl acetate copolymer or polyethylene.

On the other hand, an aqueous dispersion of the $\alpha,\beta$-ethylenically unsaturated carboxylic acid-grafted polyolefin can be easily prepared by adding its melt to stirred hot water containing a basic substance (for details of the method for its preparation, see British Patent Specification No. 1517828). If at this time, a mixture of such a graft polyolefin with ethylene/vinyl acetate copolymer, polyethylene, etc., is treated in the same way, an aqueous dispersion of the graft polyolefin and such a non-selfdispersible polyolefinic resin can be formed. Specifically, such a mixed aqueous dispersion can be easily formed by mixing 50 to 1 part by weight of an $\alpha,\beta$-ethylenically unsaturated carboxylic acid-grafted polyolefin having an acid value of about 30 to 150, preferably 50 to 130, with 50 to 99 parts by weight of a compatible non-selfdispersible polyolefinic resin such as ethylene/vinyl acetate copolymer or polyethylene, melting the mixture, and adding the uniform molten mixture to stirred hot water containing a basic compound. Accordingly, the aforesaid mixed aqueous dispersion of the grafted polyolefin and the non-selfdispersible polyolefinic resin can also be used as the aqueous dispersion of the selfdispersible polyolefinic resin as can the aforesaid mixed aqueous dispersion of the ionomer.

The non-selfdispersible polyolefin resin that can be used in combination with the ionomer or the grafted polyolefin includes homopolymers or copolymers of alphaolefins such as ethylene, propylene, 1-butene or 4-methyl-1-pentene. Specific examples are homopolymers such as polyethylene, polypropylene, poly-1-butene and poly-4-methyl-1-pentene and resinous or rubbery copolymers such as ethylene/propylene copolymer, ethylene/1-butene copolymer, ethylene/-butadiene copolymer, ethylene/propylene/butadiene terpolymer, ethylene/propylene/dicyclopentadiene terpolymer, ethylene/propylene/ethylidenenorbornene terpolymer, propylene/1-butene copolymer, propylene/butadiene copolymer, ethylene/vinyl acetate and a saponification product of ethylene/vinyl acetate copolymer. These resins can be used either singly or in combination with each other.

When the aqueous dispersion of the self-dispersible polyolefinic resin has a solids concentration of generally about 10 to about 60% by weight, preferably about 20 to about 50% by weight, it has a viscosity suitable for coating, and formation of pinholes in a coated film from the aqueous dispersion can be prevented. If desired, it is possible to minimize penetration of the aqueous dispersion into paper by adjusting its viscosity with a thickener.

The aqueous dispersion prepared in the above manner can be coated on one surface of the paper substrate in a customary manner, for example by spray coating, roller coating, gravure coating, flow coating, bar coating, etc. Usually, one coating results in a metal-deposited surface of poor luster and also tends to provide a product having poor moisture-proofness, unless the surface of the substrate is smooth. Accordingly, it is usually desirable to perform the coating two or more times until the desired smoothness of the coated surface is obtained. For example, when it is desired to apply a resin coating at a rate of 6 to 8 g/m$^2$ on one surface of the paper substrate, better results are obtained by coating the aqueous dispersion 3 or 4 times providing a resin coating of about 2 g/m$^2$ each time than by coating all the aqueous dispersion at a time.

The total amount of the aqueous dispersion coated is not critical, and can be varied according to the type of the resin used, etc. Generally, it is advantageous to adjust the total amount to about 1 to about 30 g/m$^2$, preferably about 2 to about 20 g/m$^2$, as the amount of the resin coated.

When the coating of the aqueous dispersion is repeated two or more times, it is often noted that the aqueous dispersion coated on the previously formed resin coating is repelled to cause difficulty of giving a uniform coating thereon, and vacuum deposition of a metal on the resulting non-uniform coating results in a metal layer having no inherent metallic luster which varies in color and sometimes becomes whitened. This phenomenon is liable to occur when an aqueous dispersion containing the self-dispersible carboxy-modified polyolefinic resin and being free from a surface active agent is coated two or more times. This phenomenon may be prevented by incorporating into the aqueous dispersion at least after one coating cycle a wetting agent for improving wetting of the coating surface, for example a nonionic surface-active agent such as polyoxyethylene lauryl ether, polyoxyethylene sec-butyl ether, polyoxyethylene-polyoxypropylene block copolymer, and polyoxyethylene nonylphenol. However, since such a surface-active agent is generally of low molecular weight and is liable to volatilize during an evacuating operation for metal deposition making it difficult to provide a high vacuum, the amount of such a wetting agent should be minimized. Preferably, its amount should be limited to not more than 5% by weight, preferably not more than 3% by weight, based on the resin in the aqueous dispersion.

The present inventors have now found that such a difficulty can be overcome by adding polyvinyl alcohol to the aqueous solution. Polyvinyl alcohol suitable for this purpose is obtained by saponifying polyvinyl acetate to a saponification degree of at least 75%, preferably at least 80%, and has a viscosity, as a 4% aqueous solution, of at least 3 centipoises (at 20° C.), preferably 5 to 50 centipoises (at 20° C.). Desirably, the polyvinyl alcohol does not substantially contain impurities or volatile components. If desired, the polyvinyl alcohol can also be used in the form of a random copolyer with an $\alpha,\beta$-unsaturated carboxylic acid such as acrylic acid or maleic anhydride or its derivative or with ethylene as a comonomer.

The amount of the polyvinyl alcohol is generally up to about 15% by weight, preferably about 0.03 to about 10% by weight, more preferably 0.1 to 5% by weight, based on the weight of the resin in the aqueous dispersion.

The coated aqueous dispersion is then dried. Drying can be performed at room temperature, but advantageously, at a temperature corresponding to the softening point of the coated resin or higher but below a temperature at which the paper substrate or the resin coating is thermally degraded, usually at a temperature lower than about 200° C. The drying conditions depend also upon the particle diameter of the resin particles in the aqueous dispersion. Generally, drying is preferably carried out at a relatively high temperature when the particle diameter is large, and at a relatively low temperature when the particle diameter is small. Generally, the drying may be carried out at a temperature of at least 100° C. for several seconds to several minutes. When the coating is carried out to two or more times, the drying may be carried out every time the coating is over. Or the drying may be performed at a low temperature after the first and subsequent coatings, and at a high temperature above the softening point of the resin after the final coating. In this manner, a continuous coating (a) of the resin having a thickness of generally about 1 to about 30 microns, preferably about 2 to about 20 microns, can be formed on one surface of the paper substrate.

A metal is then vacuum-deposited on the resin coating (a) formed on the paper substrate. The term "metal", as used in the present application, also denotes alloys. This vacuum deposition can be effected in a manner known per se. For example, it can be carried out by heating a metal to be deposited to a temperature above its melting point in a high vacuum of for example $10^{-3}$ to $10^{-5}$ mmHg. Examples of the metal to be deposited include aluminum, tin, zinc, lead, copper, silver, gold, manganese, magnesium, brass, nickel, chromium, Ni-Cr alloy, and Ni-Fe alloy. The thickness of the metal deposited film is not critical, and can be varied according to the utility of the final product. Generally, the thickness is about 100 to about 1000 Å, preferably about 300 to about 700 Å.

The adhesion of the resulting metal deposited film to the paper substrate through the resin coating (a) is good, and shows a satisfactory result in an ordinary adhesive tape peel test.

A thin continuous coating (b) of polyvinyl alcohol is applied to the other surface of the paper substrate which is opposite to the surface to which the resin coating (a) is applied.

The coating (b) of polyvinyl alcohol may be applied before or after the application of the resin coating (a), or before or after the vacuum deposition of metal. Generally, the thin continuous coating (b) of polyvinyl alcohol is conveniently formed by coating an aqueous solution of polyvinyl alcohol to the aforesaid other surface of the paper substrate before the vacuum deposition of metal and before or after the application of the resin coating (a).

The same polyvinyl alcohol as described hereinabove can be used. Coating may be carried out from an aqueous solution having a concentration of about 1 to about 20% by weight, preferably about 2 to about 10% by weight, once or several times in a manner known per se for example by spray coating or roller coating. The total amount of the coating is generally about 0.2 to about 5 g/m$^2$, preferably about 0.3 to about 1.0 g/m$^2$, calculated as solids.

Thus, a polyvinyl alcohol barrier layer having a thickness of usually about 0.2 to about 5 microns, preferably about 0.3 to about 1.0 micron, can be formed on one surface of the paper substrate.

When the resulting metal-deposited paper having a metal-deposited layer, preferably an aluminum-deposited layer, on one surface thereof and a polyvinyl alcohol barrier layer on the other is placed in a rolled or stacked condition, the metal-deposited surface of the paper makes contact not with the paper substrate, but with the polyvinyl alcohol layer formed on the surface of the paper substrate, and the contaminating substance contained in the paper no longer impairs the surface characteristics of the aluminum layer, such as its printability or bonding characteristics.

Since the metal-deposited paper provided by this invention has an excellent metallic luster and an aesthetic appearance and possesses low gas-permeability and moisture-permeability, it can find extensive application in various fields as labels, packaging materials for foodstuffs, tobaccos and medicines, gold and silver yarns, and condensers, etc. Depending upon these uses, it is possible to emboss the metal-deposited surface, or to impart a transparent or semitransparent color, or to form a protective layer against discoloration.

The following Examples illustrate the present invention more specifically.

EXAMPLE 1

A 5% aqueous solution of commercially available polyvinyl alcohol (C-15, a product of Shinetsu Chemical Co., Ltd.; saponification degree 98.5%, viscosity as 4% aqueous solution 22 centipoises) was coated by one operation on one surface of commercially available clay coated paper (manufactured by Fuji Kakoshi K. K.; basis weight about 52 g/m$^2$) in an amount of 0.1, 0.2, 0.3, 0.4 or 0.5 g/m$^2$ as solids, and dried for 10 seconds by blowing hot air at 120° C. against the coated surface. A barrier layer of polyvinyl alcohol having a thickness of about 0.1 to about 0.5 micron was formed on the paper.

An ionomer resin (a sodium salt of an ethylene/methacrylic acid copolymer having a methacrylic acid unit content of 15% by weight, a density of 0.95 g/cm$^3$ and a neutralization degree of 59 mole%) was mechanically dispersed in water to prepare an aqueous dispersion having a solids concentration of 20% and containing resin particles with an average particle diameter of about 0.1 micron. Polyvinyl alcohol was added in an amount of 0.1% by weight to the resulting aqueous dispersion to form a mixed aqueous dispersion. The resulting mixed aqueous dispersion was coated on the other surface of the paper three times repeatedly at a rate of about 2 g/m$^2$ each time, and each time, the resulting coating was dried at 120° C. for 10 seconds to give a paper having a resin coating with a thickness of about 6 microns. Then, in a vacuum deposition device kept at $10^{-4}$ mmHg, an aluminum layer having a thickness of 500 Å was formed by vacuum deposition on the resulting resin coating.

The aluminum-deposited surface had good peel resistance, a moisture permeability of 2, and a degree of gloss of 450.

Two samples were cut off from the aluminum-deposited paper immediately after vacuum deposition, and were superimposed so that the aluminum layer contacted the polyvinyl alcohol layer. By the testing methods shown in Table 1, variations with time of the wetting tension and ink adhesion of the aluminum surface were measured. The results are shown in Table I.

TABLE I

| Run No. | Amount of PVA coated (g/m$^2$) | Wetting tension of the aluminum surface (dynes/cm) after standing for 1 day | 3 days | 5 days | Ink adhesion after 3 day's aging |
|---|---|---|---|---|---|
| 1 | 0 | 34 | 33 | 33 | 1 |
| 2 | 0.1 | 36 | 34 | 33 | 2 |
| 3 | 0.2 | 42 | 36 | 34 | 4 |
| 4 | 0.3 | >56 | 50 | 40 | 5 |
| 5 | 0.4 | >56 | >56 | 50 | 5 |
| 6 | 0.5 | >56 | >56 | >56 | 5 |

It is generally believed that for practical purposes, the wetting tension of the aluminum surface is at least 36 dynes/cm after standing for 3 days, desirably 5 days, at 40° C. It is evident that the aluminum-deposited paper in accordance with this invention shows practical performance when the amount of the polyvinyl alcohol coated is as small as 0.2 g/m$^2$. Immediately after the vacuum deposition, the aluminum-deposited surface had a wetting tension of more than 56 dynes/cm.

EXAMPLES 2 to 9

Polyvinyl alcohol (the same as that used in Example 1) was coated on one surface of commercial simili at a rate of 0.3 g/m$^2$, and the other surface of the simili was coated with each of the following aqueous dispersions A to F by roller coating at the rates indicated in Table II repeatedly the number of times indicated in Table II to give papers having a resin coating with a thickness of about 2 to about 12 microns.

Aluminum was vacuum-deposited on the resin-coated surface of the resin-coated paper by a boat-type resistance heating method in a vacuum deposition device kept at $10^{-4}$ mmHg to form an aluminum film having a thickness of about 500 Å on the resin-coated surface of the paper.

The aqueous dispersions used to form the resin coating on the simili had the following compositions.

Aqueous dispersion A

An aqueous dispersion having a solids concentration of 35% by weight and prepared by mechanically dispersing a molten mixture of 90 parts by weight of polyethylene (density 0.92 g/cm$^3$, melt index 23 g/10 minutes) and acrylic acid-grafted polyethylene (acid value 100, intrinsic viscosity measured on a decalin solution 0.8, melting point 124° C.) in an average particle diameter of about 10 microns in water having dissolved therein potassium hydroxide.

Aqueous dispersion B

An aqueous dispersion having a solids concentration of 27% by weight and a viscosity of 500 centipoises at 25° C., and prepared by mechanically dispersing an ionomer resin (a sodium salt of an ethylene/methacrylic acid copolymer having a methacrylic acid unit content of 15% by weight, a neutralization degree of 59 mole%, a density of 0.95 g/cm$^3$, melting point of 87° C., and a melt index of 0.9 g/10 min. at 190° C. by ASTM D1238-57T) in an average particle diameter of about 0.1 micron in water.

Aqueous dispersion C

A commercially available emulsion of a vinylidene chloride-type polymer (vinylidene chloride/-butadiene/methyl acrylate copolymer, a product of Kureha Chemical Industry Co., Ltd.) having a solids concentration of 50% by weight.

Aqueous dispersion D

A commercially available emulsion of an acrylic polymer (styrene/butyl acrylate/butyl methacrylate copolymer) having a solids concentration of 42.5% by weight.

Aqueous dispersion E

A commercially available styrene/butadiene copolymer rubber latex (a product of Nippon Zeon Co., Ltd.) having a solids concentration of 50% by weight.

Aqueous dispersion F

A commercially available nitrile-butadiene copolymer rubber latex (a product of Nippon Zeon Co., Ltd.) having a solids concentration of 50% by weight.

When the aqueous dispersion A or B was coated two or more times, polyoxyethylene lauryl ether was added to the aqueous dispersions A or B coated in the second and subsequent coating cycles. The amount of polyoxyethylene lauryl ether was 0.2% based on the weight of the dispersion for the aqueous dispersion A, and 0.05% by weight based on the weight of the dispersion for the aqueous dispersion B.

The properties of the resulting aluminum-deposited papers were measured by the following methods.

(i) Peel resistance

An adhesive cellophane tape was applied to the surface of the aluminum-deposited layer, and then peeled off to examine the adhesion of the deposited layer.

(ii) Moisture permeability

Measured in accordance with ASTM D1434-58 at a temperature of 40° C. and a relative humidity of 90% (unit: g/m$^2$ 24 hrs).

(iii) Degree of gloss

Measured at a light projecting angle of 45° and a light receiving angle of 45° using an automatic angle variable glossmeter VG-107 (an instrument made by Nippon Denshoku Kogyo K.K.) in accordance with ASTM D1223-57T.

The results are shown in Table II.

The aluminum-deposited papers substantially retained the strength, elongation, and hardness of the wood-free paper used as a substrate.

TABLE II

| | Aqueous dispersion | | | Properties of the aluminum-coated paper | | |
|---|---|---|---|---|---|---|
| Example | Type | Amount coated (solids content, g/m$^2$) | Number of coatings | Peel resistance | Moisture permeability | Degree of gloss |
| 2 | A | 6 | 3 | Good | 30 | 450 |
| 3 | B | 6 | 1 | Good | 500 | 200 |
| 4 | B | 6 | 2 | Good | 5 | 500 |
| 5 | B | 6 | 3 | Good | 4 | 710 |
| 6 | C | 6 | 3 | Good | 5 | 400 |
| 7 | D | 6 | 3 | Good | 10 | 200 |
| 8 | E | 6 | 3 | Good | 8 | 400 |
| 9 | F | 6 | 3 | Good | 7 | 240 |

EXAMPLE 10

The same polyvinyl alcohol as used in Example 1 was coated at a rate of 0.4 g/m$^2$ on one surface of commercially available simili (a product of Kasuga Paper-Making Co., Ltd.; basis weight 52 g/m$^2$, width 700 mm) in the same way as in Example 1 to provide a coating of polyvinyl alcohol having a thickness of about 0.4 micron after drying. A sodium salt of an ethylene/methacrylic acid copolymer was coated on the other surface of the paper at a rate of 7 g/m$^2$ in the same way as in Example 1 to form a resin coating having a thickness of about 7 microns. Aluminum was vacuum-deposited on the resin coating to form an aluminum layer having a thickness of 400 Å. Thus, an aluminum-deposited paper having a length of 2000 meters was produced and wound up. The paper roll was allowed to stand for 3 days in an atmosphere kept at 40° C. Samples were taken from the paper roll at positions about $\frac{1}{3}$, about $\frac{1}{2}$ and about $\frac{2}{3}$ of the roll diameter from the periphery of the roll. The wetting tensions of these samples were measured, and found to be 52 dynes/cm, 54 dynes/cm, and 50 dynes/cm, respectively.

What we claim is:

1. A metal-deposited paper comprising
(i) a paper substrate;
(ii) a thin continuous resin coating (a) of a film-forming resin having good adhesion to a metal on one surface of the paper substrate, the coating (a) having been formed by coating an aqueous dispersion of the film-forming resin on the one surface of the paper substrate;
(iii) a metal film vacuum-deposited on the resin coating (a); and
(iv) a thin continuous coating (b) of polyvinyl alcohol on the other surface of the paper substrate, the coating (b) having been formed by coating an aqueous solution of the polyvinyl alcohol on the other surface of the paper substrate.

2. The paper of claim 1 wherein said film-forming resin is a synthetic resin having a polar group.

3. The paper of claim 2 wherein said polar group-containing synthetic resin is at least one resin having at least one polar group selected from the class consisting of carboxyl, carboxylate, halogen, acyloxy and nitrile, or a mixture of it with a resin free from such a polar group.

4. The paper of claim 2 wherein said polar group-containing synthetic resin comprises at least one resin selected from the group consisting of carboxy-modified olefinic resins, vinyl acetate resins, vinylidene chloride resins and acrylic resins.

5. The paper of claim 2 wherein said polar group-containing synthetic resin comprises a carboxy-modified olefinic resin.

6. The paper of claim 2 wherein said polar group-containing synthetic resin is an ionomer resin.

7. The paper of claim 2 wherein said polar group-containing synthetic resin is an alkali metal ion cross-linked product of an ethylene/methacrylic acid copolymer.

8. The paper of claim 2 wherein said polar group-containing synthetic resin is an ethylene/methacrylic acid copolymer having 5 to 45% by weight of methacrylic acid units, 30 to 80% of which are neutralized with an alkali metal ion.

9. The paper of claim 2 wherein said polar group-containing synthetic resin is a mixture of an unmodified polyolefin and an $\alpha,\beta$-ethylenically unsaturated carboxylic acid-grafted polyolefin.

10. The paper of claim 2 wherein said polar group-containing synthetic resin is a mixture of 50 to 99 parts by weight of a polyolefinic resin and 50 to 1 part by weight of an $\alpha,\beta$-ethylenically unsaturated carboxylic acid having an acid value of about 50 to about 150.

11. The paper of claim 1 wherein said film-forming resin contains at most 15% by weight, based on the weight of the resin, of polyvinyl alcohol.

12. The paper of claim 1 wherein said continuous resin coating has a thickness of about 1 to about 30 microns.

13. The paper of claim 1 wherein said vacuum-deposited metal film is an aluminum film.

14. The paper of claim 1 wherein said vacuum-deposited metal film has a thickness of about 100 to about 1000 A.

15. The paper of claim 1 wherein said coating (b) of polyvinyl alcohol has a thickness of about 0.2 to about 5 microns.

16. A process for producing a metal-deposited paper, which comprises the following steps:
(i) a step of applying a thin continuous coating (a) of a film-forming resin having good adhesion to metal to one surface of a paper substrate by coating an aqueous dispersion of said film-forming resin on the surface of the paper substrate;
(ii) a step of applying a thin continuous coating (b) of polyvinyl alcohol from an aqueous solution thereof on the other surface of the paper substrate; and
(iii) a step of vacuum-depositing a metal on the surface of the resin coating (a).

17. The process of claim 16 wherein said film-forming resin is a self-dispersible synthetic resin.

18. The process of claim 17 wherein said self-dispersible resin is an ionomer resin.

19. The process of claim 17 wherein said self-dispersible synthetic resin is an alkali metal ion cross-linked product of an ethylene/methacrylic acid copolymer.

20. The process of claim 17 wherein said self-dispersible synthetic resin is an ethylene/methacrylic acid copolymer containing 5 to 45% by weight of methacrylic acid units, 30 to 80% of which are neutralized with an alkali metal ion.

21. The process of claim 17 wherein said self-dispersible synthetic resin is a mixture of an unmodified polyolefin and an $\alpha,\beta$-ethylenically unsaturated carboxylic acid-grafted polyolefin.

22. The process of claim 17 wherein said self-dispersible synthetic resin is a mixture composed of 50 to 99 parts by weight of a polyolefin resin and 50 to 1 part by weight of an $\alpha,\beta$-ethylenically unsaturated carboxylic acid-grafted polyolefin having an acid value of about 50 to 150.

23. The process of claim 16 wherein said aqueous dispersion has a solids concentration of about 10 to about 60% by weight.

24. The process of claim 16 wherein said coating (a) is repeated at least twice.

25. The process of claim 24 wherein said aqueous dispersion contains up to 5% by weight of a nonionic surface-active agent or up to 15% by weight of polyvinyl alcohol, both based on the weight of the resin.

26. The process of claim 24 wherein said aqueous dispersion contains about 0.03 to about 10% by weight, based on the weight of the resin, of polyvinyl alcohol.

27. The process of claim 16 wherein said aqueous dispersion is coated so that the amount of solids coated is about 1 to about 30 $g/m^2$.

28. The process of claim 16 wherein the coated aqueous dispersion is dried at the softening point of the resin contained in the aqueous dispersion or at a higher temperature.

29. The process of claim 16 wherein the polyvinyl alcohol is coated with a thickness of about 0.2 to about 5 microns.

* * * * *